US008931938B2

(12) United States Patent
Kay

(10) Patent No.: US 8,931,938 B2
(45) Date of Patent: Jan. 13, 2015

(54) LOCOMOTIVE LED/OPTICS HEADLIGHT ASSEMBLY

(75) Inventor: Bradley William Kay, Mequon, WI (US)

(73) Assignee: J.W. Speaker, Corporation, Germantown, WI (US)

( * ) Notice: Subject to any disclaimer, the term of this patent is extended or adjusted under 35 U.S.C. 154(b) by 317 days.

(21) Appl. No.: 13/596,730

(22) Filed: Aug. 28, 2012

(65) Prior Publication Data

US 2013/0051045 A1 Feb. 28, 2013

Related U.S. Application Data

(60) Provisional application No. 61/528,545, filed on Aug. 29, 2011.

(51) Int. Cl.

| | |
|---|---|
| ***B61D 29/00*** | (2006.01) |
| ***F21V 5/04*** | (2006.01) |
| ***F21V 7/04*** | (2006.01) |
| ***F21S 8/10*** | (2006.01) |
| ***B61L 15/02*** | (2006.01) |
| *F21W 101/02* | (2006.01) |

(52) U.S. Cl.

CPC ..... *B61D 29/00* (2013.01); *B61L 2207/02* (2013.01); *F21S 48/1275* (2013.01); *F21S 48/328* (2013.01); *F21S 48/1154* (2013.01); *B61L 15/02* (2013.01); *F21W 2101/02* (2013.01); *F21S 48/1291* (2013.01)

USPC ..... 362/478; 362/296.05; 362/487; 362/516; 362/544; 362/545; 362/346; 362/247

(58) Field of Classification Search

None

See application file for complete search history.

(56) References Cited

U.S. PATENT DOCUMENTS

| | | | | |
|---|---|---|---|---|
| 2006/0274544 | A1* | 12/2006 | Inoue et al. | 362/509 |
| 2012/0154785 | A1* | 6/2012 | Gilliland et al. | 356/5.01 |
| 2013/0003401 | A1* | 1/2013 | Sekiguchi et al. | 362/517 |

FOREIGN PATENT DOCUMENTS

| | | |
|---|---|---|
| JP | 2000-322913 | * 11/2000 |

* cited by examiner

*Primary Examiner* — Ashok Patel

(74) *Attorney, Agent, or Firm* — Quarles & Brady LLP

(57) ABSTRACT

A headlamp assembly comprising a housing forming an internal chamber and forming an opening to one side, at least a first light source having a first illumination axis, the first light source mounted in a central portion of the internal chamber substantially at a first depth, at least a second light source having a second illumination axis, the second light source mounted in a circumferential portion of the chamber substantially at a second depth wherein the first depth is greater than the second depth, a first aspherical lens formed about a first optic axis, the first aspherical lens mounted within the opening with the first optic axis aligned with the first illumination axis and a second aspherical lens formed about a second optic axis, the second aspherical lens mounted within the opening with the second optic axis aligned with the second illumination axis.

21 Claims, 11 Drawing Sheets

LOCOMOTIVE LED/OPTICS HEADLIGHT ASSEMBLY

CROSS-REFERENCE TO RELATED APPLICATIONS

This application is based on U.S. provisional patent application Ser. No. 61/528,545 filed on Aug. 29, 2011 and entitled "LOCOMOTIVE LED/OPTICS HEADLIGHT ASSEMBLY".

STATEMENT REGARDING FEDERALLY SPONSORED RESEARCH OR DEVELOPMENT

Not applicable.

BACKGROUND OF THE INVENTION

The present invention relates to locomotive headlights and more specifically to an LED type replacement headlight assembly that meets regulated light output requirements and still fits within a typical space allotted for a locomotive headlight.

LED lighting uses less energy than incandescent type lighting, is more robust, and typically LED light sources last far longer than incandescent type sources. For this reason LED type lights are advantageous in many applications including industrial applications where work has to be halted when a light source fails. One application in which work has to be stopped when a light source fails is the locomotive headlight application.

While LED locomotive headlights would be useful and will likely be used shortly in new locomotives, there are some difficulties that have to be overcome when trying to replace existing incandescent type locomotive headlights with LED type headlights. To this end, incandescent headlight design hasn't changed much over time and a typical incandescent headlight includes a large cone shaped reflector, a filament mounted in a cavity formed by the reflector, a 7 inch round lens over the cavity and some type of mechanical connector for securing the headlight into a cavity formed at the front end of a locomotive. Here, a standard headlight receiving cavity is approximately 7 inches round and has a depth only large enough to accommodate the headlight.

In addition to being size limited, federal transportation regulations require very specific light intensity and light pattern characteristics.

BRIEF SUMMARY OF THE INVENTION

It has been recognized that the intensity and light pattern requirements for a locomotive headlight can be achieved in the space allotted for such headlights on legacy locomotives by packaging a plurality of LEDs and optics in a two tier manner within a heat sink housing structure. To this end, consistent with at least some aspects of the present disclosure, at least one LED may be mounted generally centrally on a PCB that is mounted deep in the housing and other LEDs may be mounted peripherally on a peripheral PCB that is mounted more shallowly within the housing structure where patterns of light generated by the LEDs and associated optics combine to meet intensity and pattern requirements.

It has also been recognized that a pattern of LEDs and optics can be constructed such that the resulting combined light pattern is symmetrical about a central light axis so that the light assembly can be installed at any rotational angle and still generate a light pattern having pattern characteristics that meet regulatory pattern requirements. In this manner the design of the LED light assembly can render it impossible to install the assembly in a manner which does not meet regulations.

Consistent with the above comments, some embodiments of the present disclosure include a headlamp assembly comprising a housing forming an internal chamber and forming an opening to one side that opens into the chamber, at least a first light source having a first illumination axis, the first light source mounted in a central portion of the internal chamber substantially at a first depth and to direct light out the opening, at least a second light source having a second illumination axis, the second light source mounted in a circumferential portion of the chamber substantially at a second depth and positioned to direct light out the opening wherein the first depth is greater than the second depth a first aspherical lens formed about a first optic axis, the first aspherical lens mounted within the opening with the first optic axis aligned with the first illumination axis so that the first aspheric lens substantially collimates at least a portion of the light from the first light source and a second aspherical lens formed about a second optic axis, the second aspherical lens mounted within the opening with the second optic axis aligned with the second illumination axis so that the second aspheric lens substantially collimates at least a portion of the light from the second light source.

In some embodiments the chamber has a central portion and a circumferential portion that surrounds the central portion, the central and circumferential portions have the first and second depths, respectively. In some embodiments the chamber is formed in part by a base wall member, a cylindrical side wall member and a circumferential wall member wherein the base wall member and circumferential wall member each form a substantially flat surface, the base wall member is substantially circular, the circumferential wall member is substantially ring shaped and the side wall member connects an outer edge of the base wall member to an inner edge of the circumferential wall member.

In some embodiments the first and second light sources include first and second LEDs mounted to first and second PCBs, respectively, the first PCB mounted to a central portion of the base wall member and the second PCB mounted to the circumferential wall member. Some cases further include at least a third LED mounted to the second PCB, the third LED having a third illumination axis and positioned to direct light out the opening. Some cases further include a plurality of additional LEDs mounted to the second PCB and a separate lens mounted within the opening and aligned with each of the additional LEDs.

In some embodiments the second PCB is ring shaped. In some embodiments the housing is formed of aluminum. Some cases further include a plurality of additional light sources mounted in the circumferential portion of the chamber substantially at the second depth and positioned to direct light out the opening and a plurality of additional aspherical lens mounted within the opening, a separate one of the additional aspherical lenses aligned with each of the additional light sources so that the additional aspherical lenses substantially collimates at least portions of the light from the additional light sources.

In some embodiments the second light source and the plurality of additional light sources include a first plurality of light sources, the assembly further including a second plurality of additional light sources mounted in the circumferential portion of the chamber substantially at the second depth and positioned to direct light out the opening and a plurality of concentrator lenses mounted within the opening, a separate one of the concentrator lenses aligned with each of the second plurality of additional light sources. In some embodiments the first plurality of light sources includes four light sources spaced about the circumferential portion and the second plurality of additional light sources includes six additional light sources.

In some embodiments the second and additional aspherical lenses include a circumferential set of aspherical lenses and wherein the concentrator lenses separate the lenses in the circumferential set. In some embodiments each of the lenses is formed about an optic axis and wherein all of the optic axis of the lenses are substantially parallel. In some embodiments the assembly is formed about a light axis and wherein the light pattern created by the light sources is substantially symmetrical about the light axis such that the light pattern is substantially constant irrespective of how the assembly is rotated about the light axis.

Other embodiments include a headlamp assembly comprising a housing forming an internal chamber and forming an opening to one side that opens into the chamber, at least a first light source having a first illumination axis, the first light source mounted in the internal chamber to direct light out the opening, at least a second light source having a second illumination axis, the second light source mounted in the chamber and positioned to direct light out the opening, a first aspherical lens formed about a first optic axis, the first aspherical lens mounted within the opening with the first optic axis aligned with the first illumination axis so that the first aspheric lens substantially collimates at least a portion of the light from the first light source so that the first light source creates a light pattern including an intense central spot and a halo there around where the halo is separated from the intense spot by a low luminance ring and a first concentrator lens formed about a second optic axis, the first concentrator lens mounted within the opening with the second optic axis aligned with the second illumination axis so that the first concentrator lens creates a light pattern that is intense within the low luminance ring.

Some cases further include at least a third light source mounted within the chamber and a second concentrator lens mounted within the opening and that is aligned with the third light source so that the second concentrator lens creates a light pattern that is intense within the low luminance ring. Some cases further include at least third through seventh light sources mounted within the chamber and second through sixth concentrator lenses mounted within the opening, a separate one of the second through sixth concentrator lenses aligned with each of the third through seventh light sources so that the second through sixth concentrator lenses create a light pattern that is intense within the low luminance ring.

In some embodiments the first aspherical lens is centrally mounted within the opening and the concentrator lenses surround the first aspherical lens. Some cases further include additional light sources mounted in the chamber and a separate additional aspheric lens mounted within the opening and aligned with each of the additional light sources, each of the additional aspheric lenses collimating at least a portion of the light from an aligned light source so that a resulting light pattern includes an intense central spot and a halo there around where the halo is separated from the intense spot by a low luminance ring.

Still other embodiments include a headlamp assembly comprising a housing forming an internal chamber and forming an opening to one side that opens into the chamber, a plurality of light sources, each light source having an illumination axis and each mounted in the internal chamber to direct light out the opening, the plurality of light sources including a first light source, a first aspherical lens formed about a first optic axis and having a first depth along the first optic axis, the first aspherical lens mounted within the opening with the first optic axis aligned with the illumination axis of the first light source so that the first aspheric lens substantially collimates at least a portion of the light from the first light source, a plurality of second aspherical lenses, each of the second aspherical lenses formed about a separate optic axis and having a second depth along the separate optic axis that is less than the first depth, each second aspherical lens mounted within the opening with the separate optic axis aligned with one of the illumination axis of one of the light sources so that each second aspherical lens substantially collimates at least a portion of the light from the aligned light source, wherein, the all of the optic axis are substantially parallel and wherein the second aspherical lenses surround the first aspherical lens.

In some embodiments the first aspheric lens forms a first diameter that is substantially perpendicular to the first optic axis and each of the second aspherical lenses forms a diameter that is substantially perpendicular to the optic axis of the second aspherical lens and wherein the second diameter is less than the first diameter. In some embodiments the second depth dimension is less than 90% of the first depth dimension. In some embodiments the second depth dimension is less than half the first depth dimension. In some embodiments the second diameter is less than 90% of the first diameter. In some embodiments the second diameter is less than half the first diameter.

Other embodiments include a headlamp assembly comprising a housing forming an internal chamber about a housing axis and forming an opening to one side that opens into the chamber, a plurality of light sources, each light source having an illumination axis and each light source mounted within the chamber to direct light out the opening, a first plurality of aspherical lenses, each aspherical lens formed about an optic axis and mounted within the opening with the optic axis of the lens aligned with one of the illumination axis and a second plurality of concentrator lenses, each concentrator light source forms about an optic axis and mounted within the opening with the optic axis of the lens aligned with one of the illumination axis, wherein the light pattern generated by the light sources and first and second pluralities of lenses is substantially symmetric irrespective of orientation of the housing with respect to the housing axis.

Other embodiments include a light comprising a light source that generates light centered along an illumination axis, an aconical reflector formed about the illumination axis, the reflector having a reflector surface that is symmetrical about the illumination axis and that is open at first and second ends where the reflector tapers away from the illumination axis between the first and second ends and where the angle formed between the surface reflector surface and the illumination axis is different at different locations along the reflector surface, the reflector mounted with the light source located within the opening at the first end, an aspherical optic mounted at the second end of the aconical reflector, wherein, a first portion of the light from the light source directly enters the optic and is collimated by the optic to generate a high intensity light spot along the illumination axis and a second portion of the light from the light source reflects off the reflector and enters the optic and emanates from the optic at angles with respect to the illumination axis to generate a low luminance halo about the illumination axis and separated from the spot.

To the accomplishment of the foregoing and related ends, the invention, then, comprises the features hereinafter fully described. The following description and the annexed drawings set forth in detail certain illustrative aspects of the invention. However, these aspects are indicative of but a few of the various ways in which the principles of the invention can be employed. Other aspects, advantages and novel features of the invention will become apparent from the following detailed description of the invention when considered in conjunction with the drawings.

Figure 1:
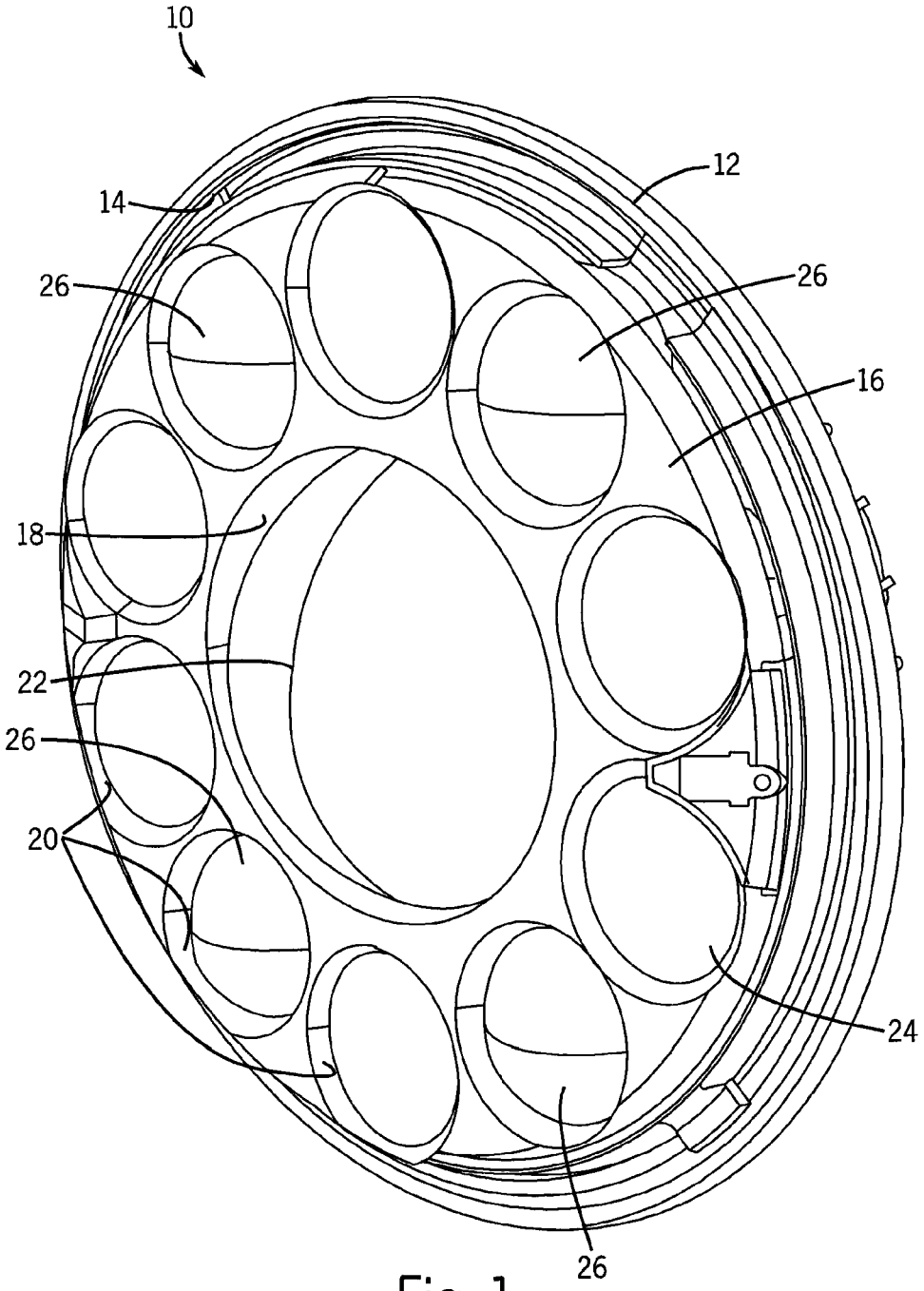
FIG. 1 is a perspective view of a locomotive LED/optics headlight assembly that is consistent with at least some aspects of the present invention.
Figure 2:
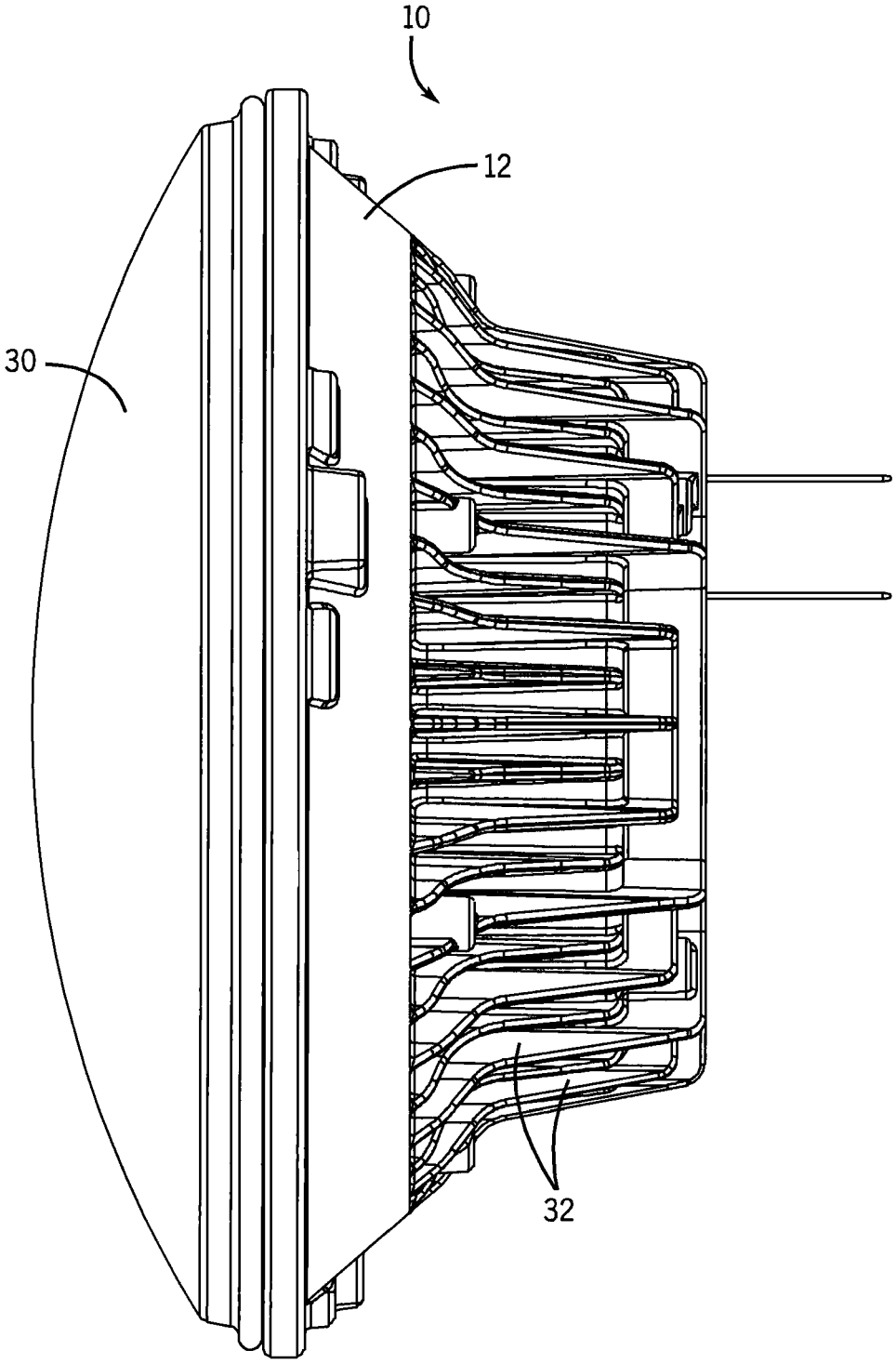
FIG. 2 is a side view of the assembly shown in FIG. 1.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

The various aspects of the subject invention are now described with reference to the annexed drawings, wherein like reference numerals correspond to similar elements throughout the several views. It should be understood, however, that the drawings and detailed description hereafter relating thereto are not intended to limit the claimed subject matter to the particular form disclosed. Rather, the intention is to cover all modifications, equivalents, and alternatives falling within the spirit and scope of the claimed subject matter.

The word "exemplary" is used herein to mean serving as an example, instance, or illustration. Any aspect or design described herein as "exemplary" is not necessarily to be construed as preferred or advantageous over other aspects or designs.

Referring now to the drawings wherein like reference numerals correspond to similar elements throughout the several views and, more specifically, referring to FIGS. 1 through 7, at least some embodiments of the present invention include a locomotive lamp or light 10 to be used as a headlight for a locomotive. The headlight 10 includes a plurality of components including, among others, a plurality of light emitting diodes (LEDs) (see 56 and 58 in FIG. 6) mounted within a cavity 50 formed by a headlight housing 12 where the components are selected and arranged to generate a light pattern (see exemplary pattern illustrated in FIG. 8) that meets regulatory requirements for locomotive headlamps. To this end, regulations require that a locomotive headlight generate light having an intensity of at least 200,000 candela at the center of the beam and lesser candela at the angles diverging there from. As can be seen in the light pattern in FIG. 8, intensity near the center of the pattern far exceeds the regulatory requirements.

Figure 8:
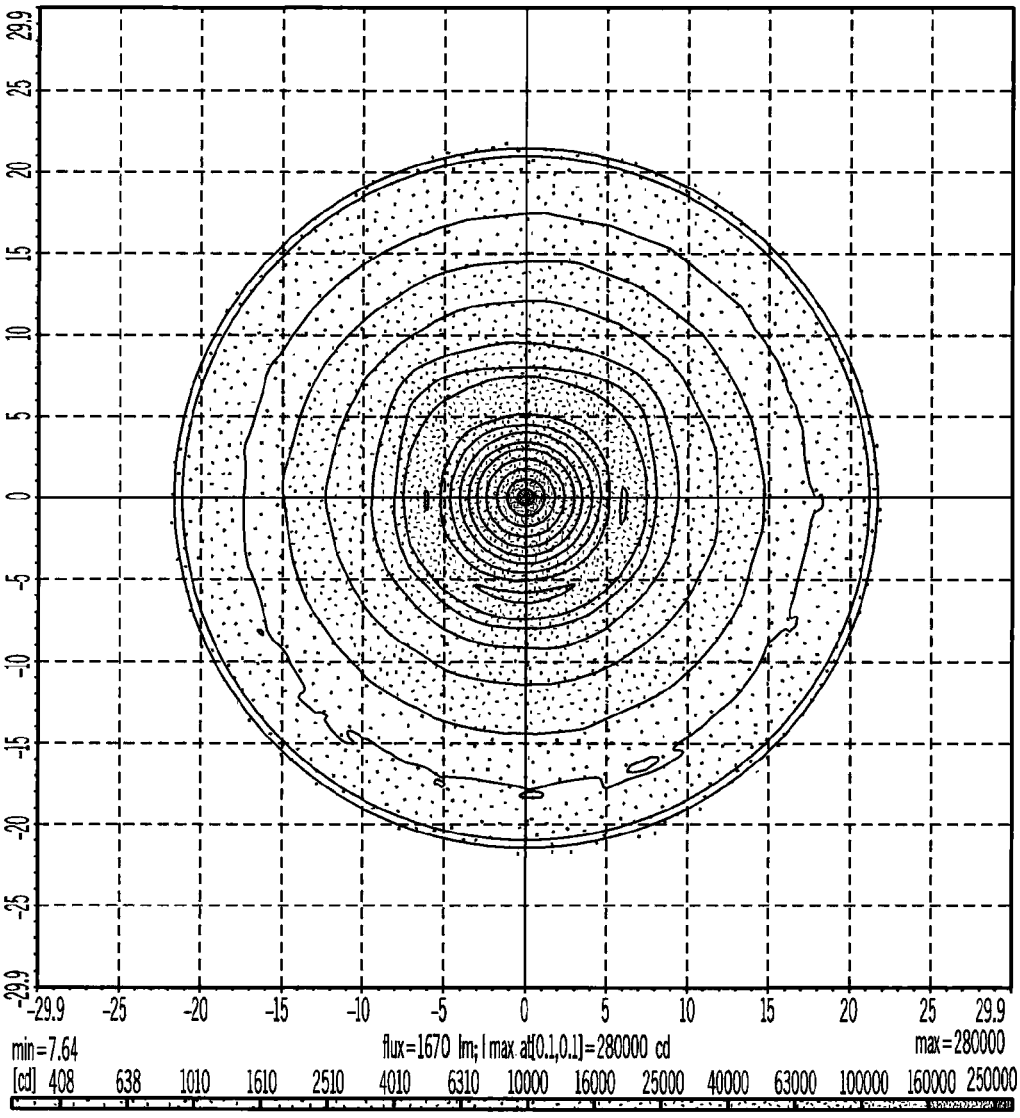
FIG. 8 is a light intensity pattern that results from the light assembly shown in FIGS. 1-6.

It should also be appreciated from the pattern in FIG. 8, that the pattern is axially symmetrical such that the pattern is identical irrespective of rotation of the pattern about a central axis of the pattern and hence, the pattern generated by the exemplary locomotive headlight would be substantially identical irrespective of the angle about the central axis at which the headlight is installed. This is important as, in addition to specifying candela requirements of the pattern, the regulations specify the spread of the pattern at different angles to the lateral sides of the central axis of the pattern. In the present case, because the pattern is symmetrical about the central axis, when the headlight is being installed, it is impossible to install the headlight at an incorrect angle as all angles of installation should meet the regulator requirements.

To form a light pattern that meets the regulatory requirements using LEDs within the form factor allotted for a headlight in existing locomotives, it has been recognized that several LEDs are required along with special optical components and reflectors wherein each of the LEDs and associated optics provide a portion of the light pattern such that the portion of the patterns, when taken together, result in a pattern that meets the overall regulatory requirements. To this end, the exemplary headlight illustrated in FIGS. 1 through 7 includes a housing member 12, a lens 30, eleven LEDS 56, 58 mounted to two different printed circuit boards (PCBs) 40 and 42, an internal support baffle 28, a fascia cover 16, a central aspherical optic 22, four side aspherical optic collectively identified by numeral 26, six side concentrator optics collectively identified by numeral 24, four reflectors 70 (see specifically FIG. 7), and several mechanical connectors (not labeled).

Housing member 12, in at least some embodiments, is formed of aluminum which, in addition to providing a protective encasement for other light components, operates as a heat sink to draw heat away from the other components. To this end, housing member 12 forms a generally cylindrical central cavity 50 that is open to one side (see FIG. 6) and a plurality of fins 32 formed on an external surface for dissipating heat. Cavity 50 is formed to have a dual depth that forms a first deep mounting surface 54 in a central portion and a second relatively shallow mounting surface 52 along a circumferential portion. The deep mounting surface or base wall member 54 is generally circular and flat while shallow surface or circumferential wall member 52 is doughnut shaped and generally circumscribes the deeper central portion of the cavity 50 and is spaced there from by a cylindrical side wall member (not labeled). Housing member 12 forms a circular rim 14 about the cavity 50 at the open side and a recessed shelf surface 33 on the inside of the rim 14 for supporting the baffle member 28 (see FIG. 6).

First PCB 40 is circular and dimensioned to be received within the deeper portion of cavity 50 on the first mounting surface 54. A central LED 58 (see FIG. 6) is mounted to a center of PCB 40 such that, after assembly of light 10, the central LED is located substantially in the middle of the opening formed by rim 14. Other headlight circuitry is mounted to PCB 40 including a headlight controller/processor (not labeled), an LED driver (not labeled), operating parameter sensors (not labeled), etc. In at least some embodiments PCB 40 is mounted to surface 54 via screws or other types of mechanical fasteners.

Figure 5:
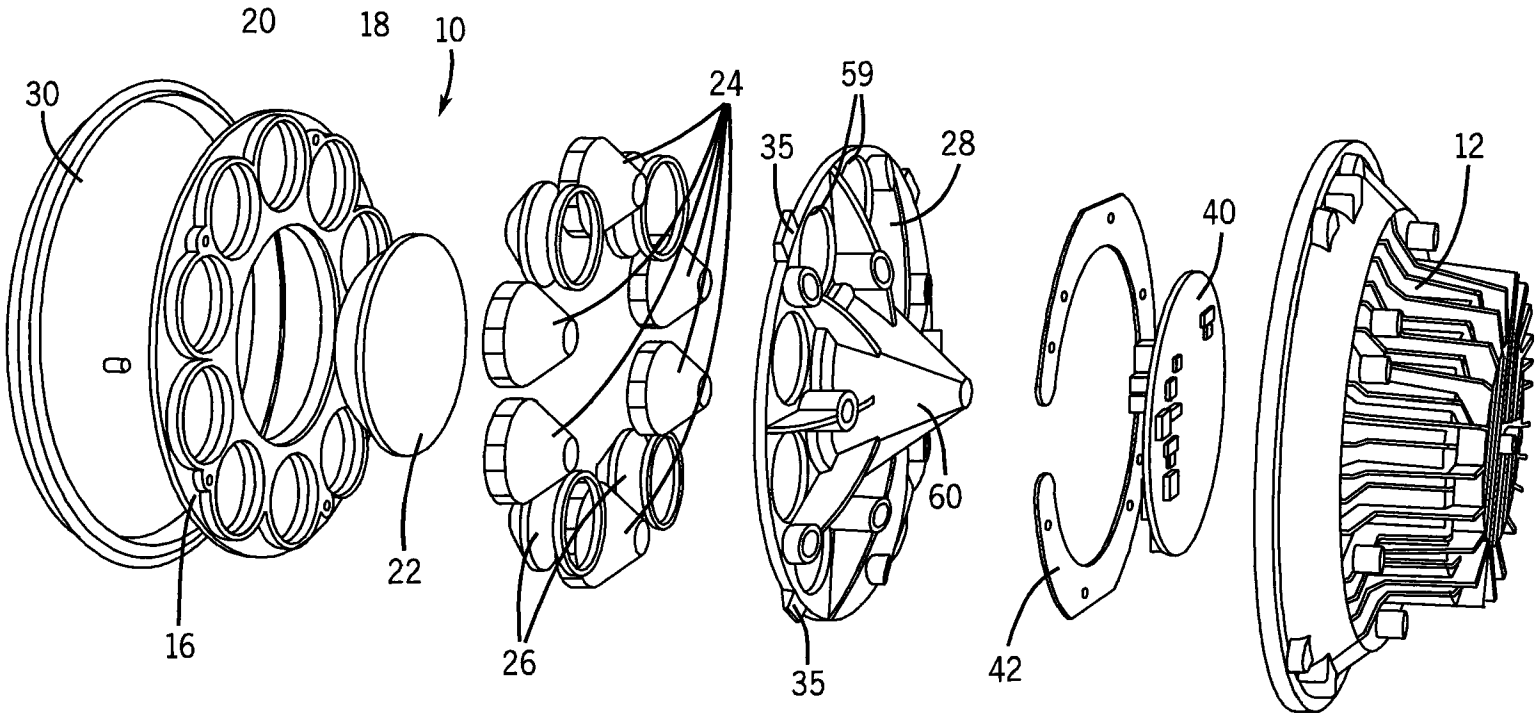
FIG. 5 is an exploded view of the assembly shown in FIG. 1.

Second PCB 42 is doughnut shaped and dimensioned to be received on the shallower mounting surface 52. Ten side LEDs 58 (see two of the side LEDs in FIG. 6) are mounted to PCB 42 to form a circle about a central light axis 69. Other headlight circuitry may also or in addition be mounted to PCB 42 including any of the control circuitry, sensors, driver, etc., described above. In at least some embodiments PCB 40 is mounted to surface 54 via screws or other types of mechanical fasteners. In at least some embodiments, as illustrated in FIG. 5, the second PCB 42 may be formed of two crescent shaped PCB sections that are separately mounted to the mounting surface 52 upon headlight assembly. Each of the LEDs has an illumination axis (see first and second illumination axis 69 and 99 in FIGS. 6 and 7, respectively) that is substantially perpendicular to the PCB to which the LED is mounted.

In at least some embodiments support baffle 28 is molded from plastic and generally includes a circular disc member having a radial dimension such that a rear surface thereof, when the baffle is placed in the cavity 50, contacts the shelf surface 33 and supported thereby. In some embodiments, instead of the rear surface of baffle 28 contacting the shelf surface 33, tabs 35 are provided along an edge of baffle 28 that extend outward and contact the shelf surface 33. In some cases the inside wall of housing 12 adjacent the rim 14 will form keyed openings for receiving the tabs and thereby locking the baffle 28 to the housing to ensure that the baffle 28 does not rotate about axis 69 within the housing 12.

Baffle 28 forms a central opening 71. Referring to FIG. 5, baffle 28 also forms ten circular openings (two of which are labeled 59 in FIG. 5) about a circumferential portion thereof that are equi-spaced about the cone 60. Each opening is formed to receive one of the side optics 24 or 26 and to, as the label implies, support the side optic within the housing adjacent the housing rim 14. Baffle 28 forms a rearward extending cone 60 (see FIG. 6) about central opening 71 and includes reinforcing ribs (not labeled) that extend from a rear surface and that extend radially from the cone 60 toward a circumferential edge.

Cone 60 forms a polished aconically shaped internal surface 64 and is open at a distal end. Surface 64 is metalized to provide a specular or shiny reflective surface. The specular surface 64 forms an angle (e.g., between 25 and 45 degrees in at least some embodiments and substantially 35 degrees in some embodiments) with the central axis 69 of the headlight that is substantially constant along most of the depth of the specular surface, but that tappers slightly near the distal end so that at the distal end the angle with the axis 69 is slightly less (e.g., on the order of 10 to 25 degrees and in some embodiments substantially 18 degrees). Thus, reflector 60 is not conical and instead is aconical in shape. In these embodiments where the angle of the cone tapers at the distal end, the tapering has been specifically designed so that light reflected from an LED 58 (see again FIG. 6) at the center of the reflective surface is reflected at specific angles so that the light enters and exits an associated optic 22 (see FIG. 9) at specific angles and causes a halo portion 102 of the overall light pattern shown in FIG. 8 as described in greater detail below where the halo portion includes a relatively low luminance ring. The cone 60 is dimensioned to extend to the front surface of PCB 40 after installation and, because of its central location, is aligned with and receives the central LED in the open distal end.

In at least some embodiments, baffle 28 also forms four additional cone shaped extensions (see exemplary extension 70 shown in FIG. 7), each additional cone extension circumscribing a separate one of the openings 59 and extending rearward there from. Each extra cone extension 70 has a generally aconical internal cone shaped surface 72 and is open at its distal end. Surface 72 is metalized to provide a specular surface. The four additional codes extensions are aligned with separate ones of the LEDs 56 so that upon assembly, the aligned LED is located within the distal opening of the extension.

In the illustrated embodiment, referring specifically to FIG. 1, the additional cone shaped extensions are formed such that each aligns with a different one of the aspheric side optics 26 where the four aspheric side optics 26 are arranged as shown. More specifically, with a first side optic shown at a 12 o'clock position in FIG. 3 and second through tenth side optics consecutively arranged in a clockwise direction, the first aspheric side optic is the second optic in the clockwise direction, the second aspheric side optic is the fifth optic shown in the clockwise direction, the third aspheric side optic is the seventh optic shown in the clockwise direction and the fourth aspheric side optic is the tenth optic shown in the clockwise direction and therefore extra cone extensions 70 would be formed by the baffle 28 for each of the second, fifth, seventh and tenth openings.

Although not illustrated, in other embodiments the cones 60, 70 may be provided as separate components sandwiched between a baffle 28 and a PCB or the like or otherwise mechanically mounted to the baffle to be aligned with the LEDs as described above.

Figure 7:
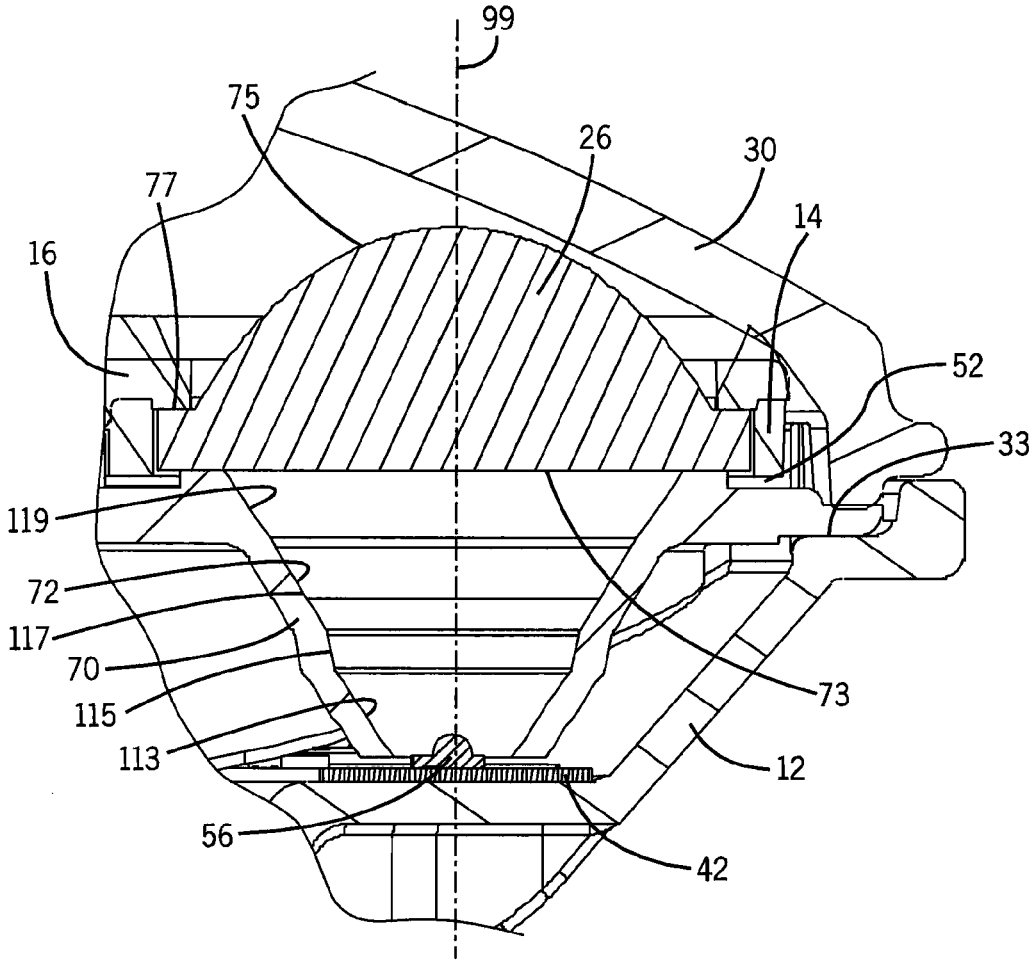
FIG. 7 is a cross-sectional view of one of the optics shown in FIG. 3.

Referring now more specifically to FIG. 7, surface 72, in at least some embodiments, is comprised of four separate conical surfaces including a first conical surface 113 proximate the distal end, a second conical surface 115 proximate the first conical surface 83, a third conical surface 117 proximate the second conical surface 85 and a fourth conical surface 119 proximate the third conical surface 87 and adjacent optic 26 after assembly. The first, second, third and fourth conical surfaces 83, 85, 87 and 89, respectively, form angles of between 28 degrees and 36 degrees, 11 degrees and 19 degrees, 26 degrees and 34 degrees and 30 degrees and 38 degrees with respect to a central axis of LED 56 associated therewith and in at least some applications, of 32 degrees, 15 degrees, 30 degrees and 34 degrees, with respect to the central axis of LED 56, respectively.

Figure 6:
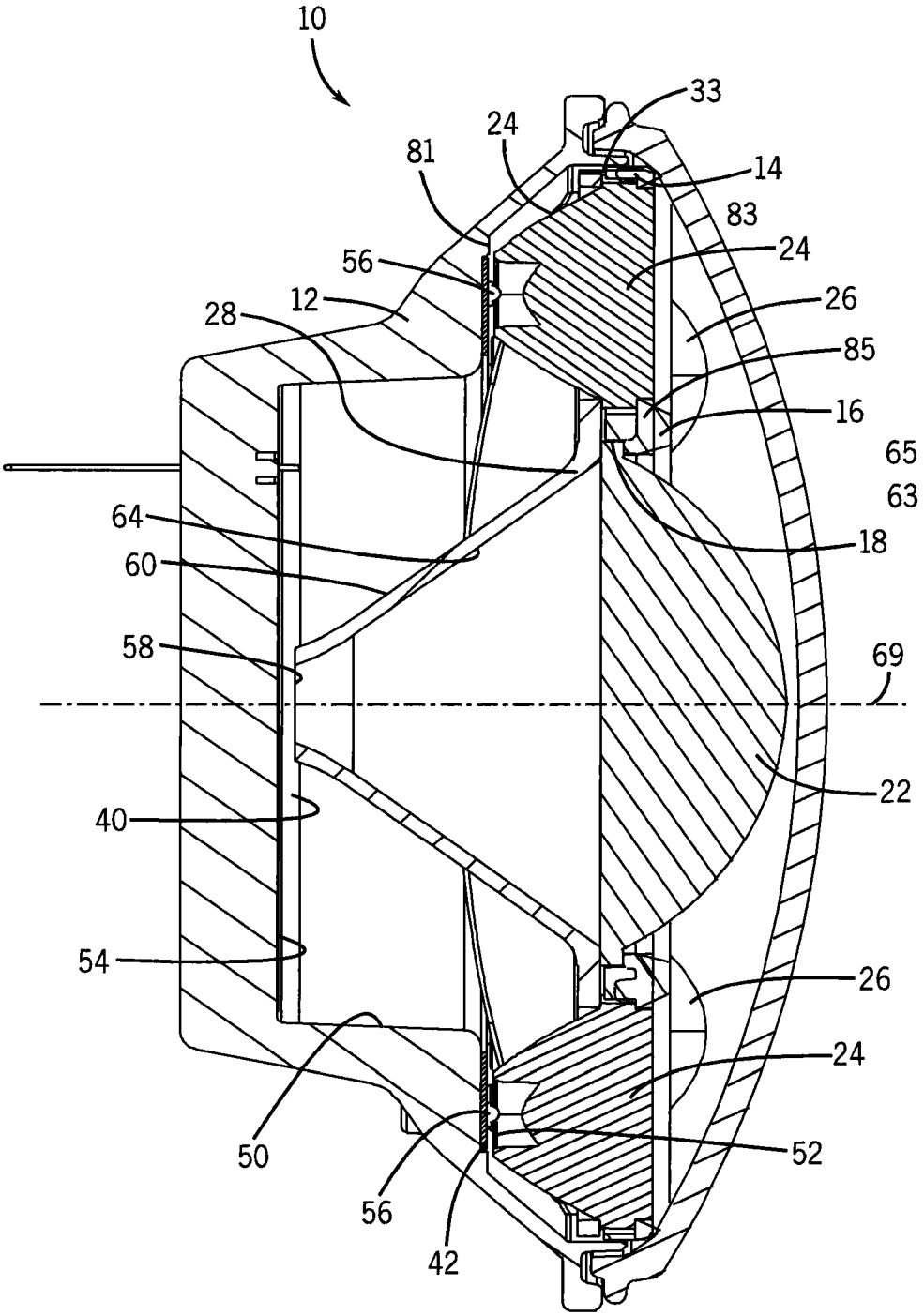
FIG. 6 is a cross-sectional view taken along the line B-B of FIG. 3.
Figure 9:
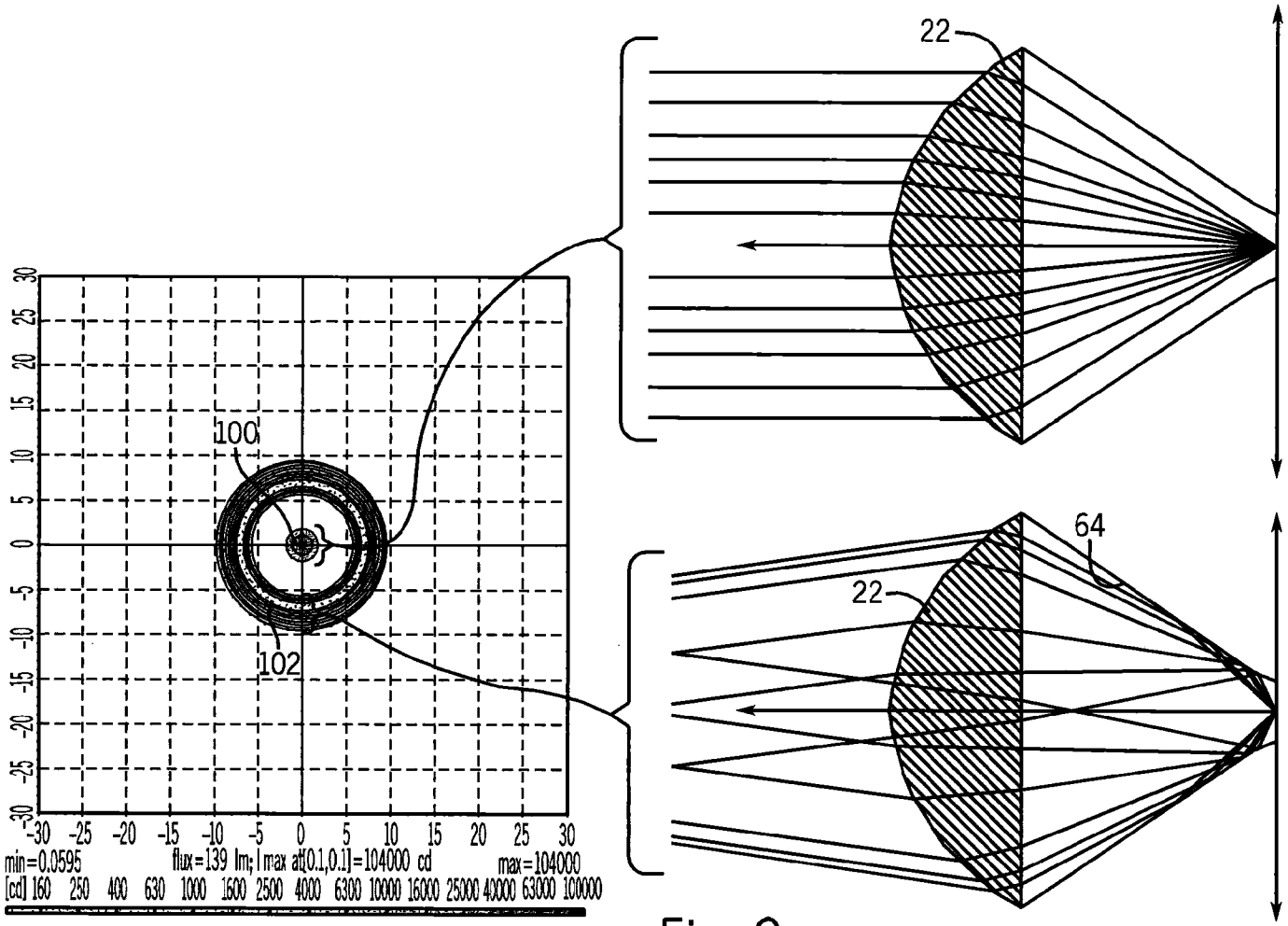
FIG. 9 is a schematic showing light patterns generated by the central optic and associated reflector that forms part of the assembly shown in FIGS. 1-6.

Referring to FIGS. 1, 3, 5 and 6, central optic member 22 is formed of glass or plastic and has a cross sectional shape as shown in FIG. 6 that is aspheric including a flat rear light entry surface 61, a curved light exit surface 63 opposite the light entry surface and a circumferential lip 65. The shape is such that optic 22 is a pure collimating optic with no aberrations. Entry surface 61 is dimensioned to be larger than central opening 71 so that optic member 22 can be supported by the front surface of baffle 28 (see FIG. 6). Referring also to FIG. 9, optic 22 and the internal surface 64 of the cone shaped reflector 60 are illustrated twice (see upper right and lower right portions of FIG. 9) along with different light rays from an LED located in the opening at the distal end of the reflector 60. The left hand side FIG. 9 illustrates a light pattern formed by just the central optic 22.

As can be seen in the upper right hand portion of FIG. 9, a portion of the light from an LED travels directly to the rear surface of optic 22 without reflecting off surface 64 and is collimated by optic 22 and exits optic 22 along parallel lines where the parallel lines are parallel to a central axis through the optic 22. The collimated light forms a spot at the central portion 100 of the pattern in FIG. 9 that has extremely high intensity (e.g., approximately 100,000 candela in the first 1 degree off center).

The lower right hand portion of FIG. 9 shows a portion of light from an LED that reflects off surface 64 and that exits optic 22 at angles that are not parallel to the optic axis and that form a doughnut shaped or halo shaped portion 102 (i.e., a low luminance ring) of the light pattern between approximately 6 and 9 degrees off center. Here, the halo shaped portion of the light pattern has an intensity of approximately 10,000 candela between 7 and 8 degrees off center and lesser intensity at other angles. Thus, the combination of the central optic and aconical reflector generate the FIG. 9 pattern which is advantageous for a locomotive application when combined with patterns from other LED/reflector/optic combinations that comprise the headlight 10.

Referring to FIGS. 1, 3, 5 and 7, aspheric side optic members 26 are each similar and therefore only one is described here in detail. An exemplary aspherical side optic 26 has a shape which is similar to the central optic member 22, but has smaller dimensions suitable for covering one of the side openings 59 formed by baffle 28. To this end, as best seen in FIG. 7, each aspheric side optic 26 has a flat light entry surface, a curved light exit surface 75 and a circumferential rim 77. Each optic 26 is formed of plastic or glass.

Figure 10:
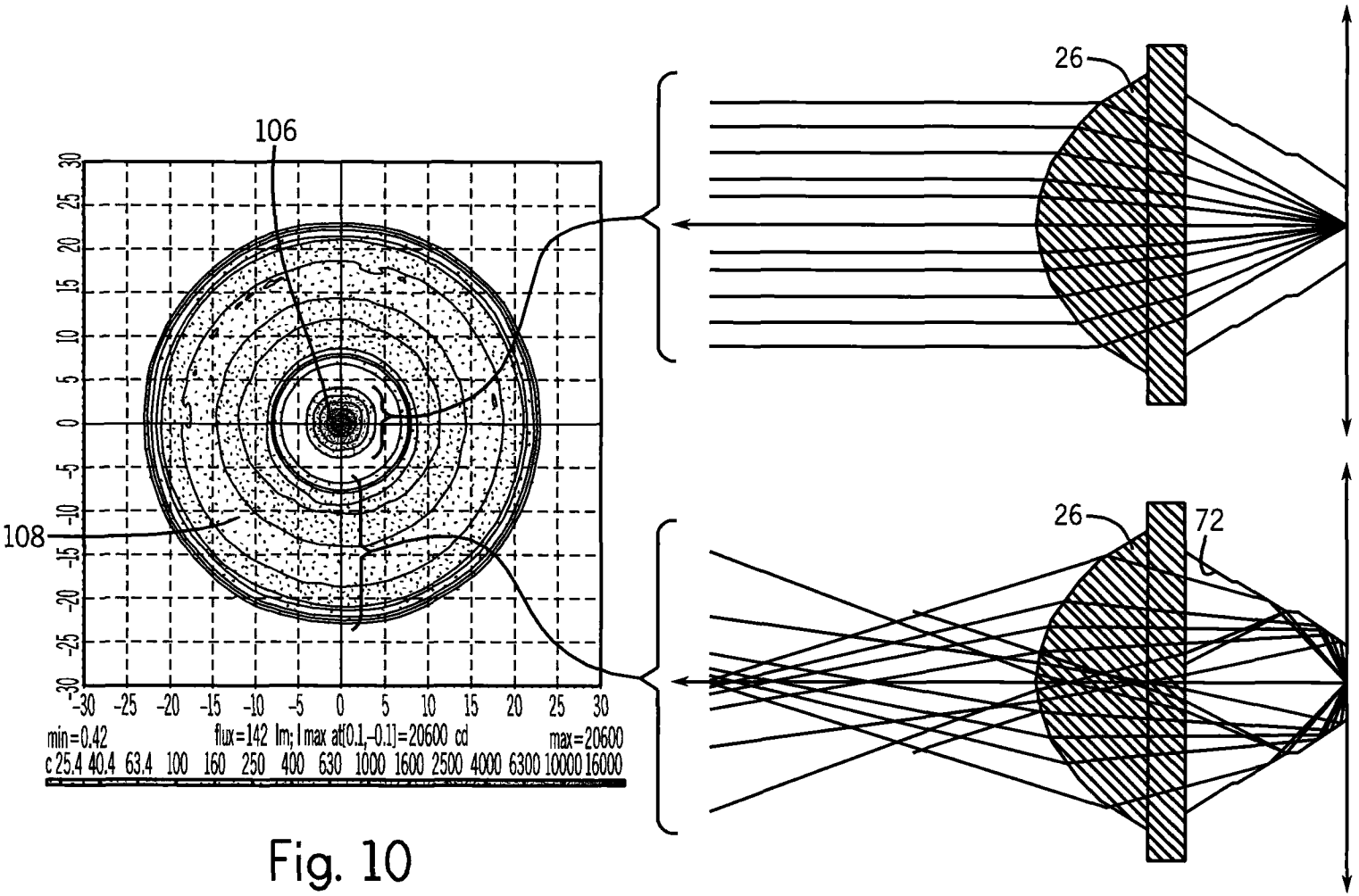
FIG. 10 is similar to FIG. 9, albeit showing light patterns generated by an exemplary one of the peripheral optics and associated reflector in FIGS. 1-6.

Referring also to FIG. 10, optic 26 and the internal surface 72 of the cone shaped reflector 70 are illustrated twice (see upper right and lower right portions of FIG. 10) along with different light rays from an LED located in the opening at the distal end of the reflector 70. The left hand side FIG. 10 illustrates a light pattern formed by just one of the aspherical side optics 26. As can be seen in the upper right hand portion of FIG. 10, a portion of the light from an LED travels directly to the rear surface of optic 26 without reflecting off surface 72 and is collimated by optic 26 and exits optic 26 along parallel lines where the parallel lines are parallel to a central axis through the optic 26. The collimated light forms a spot at a central portion 106 of the pattern in FIG. 10 that has a high intensity (e.g., approximately 20,000 candela in the first 1 degree off center and tapering off there from out to about 4 degrees off center). In the exemplary headlight 10 (see FIG. 1), because there are four aspherical side optics 26, the total candela at the center of the pattern due to the combination of all four is approximately 80,000 candela.

The lower right hand portion of FIG. 10 shows a portion of light from an LED that reflects off surface 72 and that exits optic 26 at angles that are not parallel to the optic axis and that form a halo or doughnut shaped portion 108 of the light pattern between approximately 7 and 23 degrees off center. Here, the doughnut shaped portion of the light pattern has an intensity of approximately 250 candela between 8 and 22 degrees off center and lesser intensity at other angles. Again, because there are four aspherical side optics 26, the total candela between 8 and 22 degrees due to the combination of all four is approximately 1,000 candela.

Referring to FIGS. 1, 3, 5 and 6, concentrator side optic members 24 are each of similar construction and operate in a similar fashion. LED concentrator optics are well known in the art and therefore optic 24 will not be described here in detail. It should suffice to say that optic 24 is generally cone shaped with a recess formed at an apex end where light enters the optic and a flat light exit surface 83, has a convex light entry surface 81 is formed in the opening and includes a parabolic outer surface (not labeled). An exemplary concentrator side optic 24 shown if cross section in FIG. 6. A circumferential rim 85 is formed about each of the optics 24. Each optic 24 is formed of plastic or glass.

Figure 11:
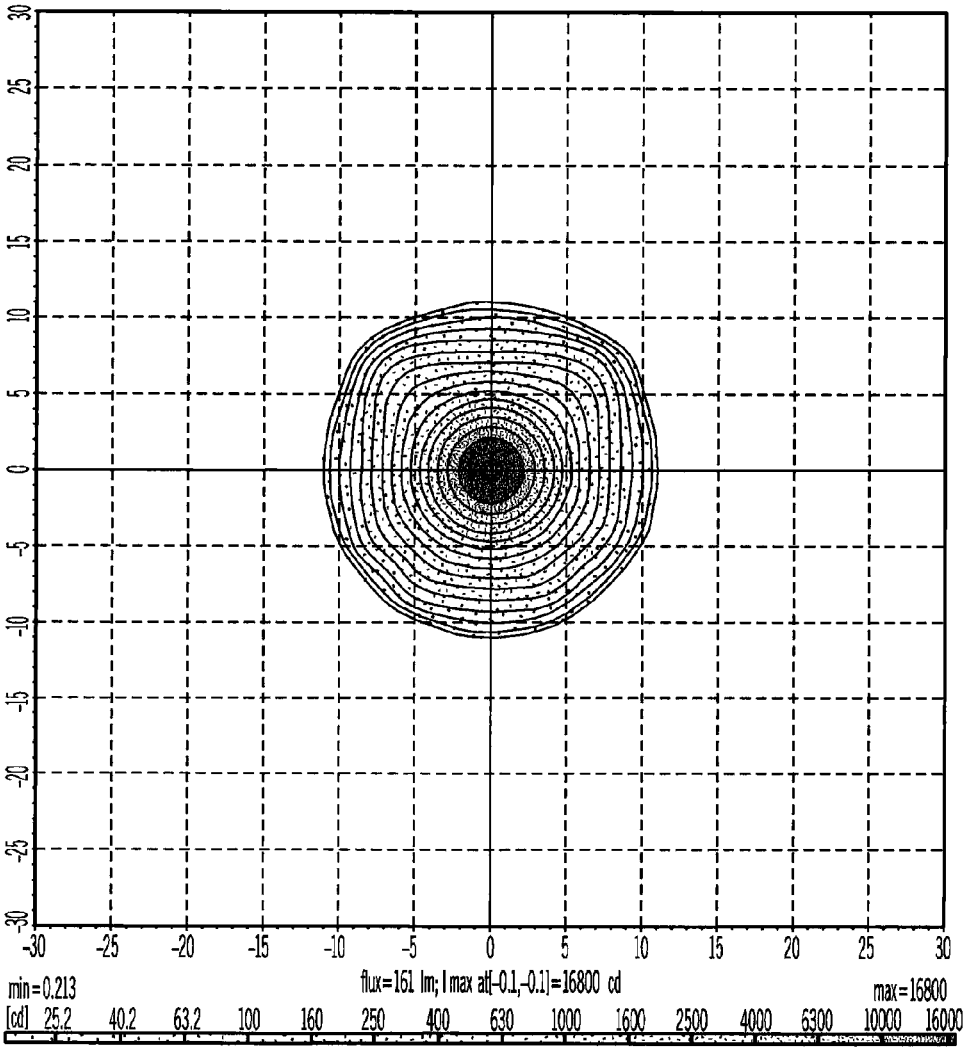
FIG. 11 shows a light pattern generated by one of the concentrator optics in the assembly shown in FIGS. 1-6.

Referring to FIG. 11, a light pattern associated with one of the concentrator optics is illustrated. As can be seen, the concentrator optic light pattern generates approximately 17,000 candela within the first 1.5 degrees off the central axis, approximately 3,000 candela from 2 to 5 degrees, approximately 630 candela from 5 to 7 degrees and approximately 100 candela from 7 to 9 degrees. Because there are six of the side concentrator optics, the light pattern for all six combine includes approximately 68,000 candela within the first 1.5 degrees off the central axis, approximately 12,000 candela from 2 to 5 degrees, approximately 3800 candela from 5 to 7 degrees and approximately 600 candela from 7 to 9 degrees.

When all of the patterns from all of the LEDs and optics are combined, the FIG. 8 pattern results which includes approximately 250,000 candela out to one degree off the central axis, approximately 150,000 candela between 1 and 2 degrees, approximately 25,000 candela between 2 and 3 degrees, approximately 16,000 candela between 3 and 5 degrees, approximately 5,000 candela between 5 and 7 degrees, approximately 3,000 candela between 7 and 9 degrees, approximately 1,000 candela between 9 and 13 degrees and approximately 400 candela between 13 and 22 degrees. Thus, by combining several light patterns from several different types of optics and reflector combinations, the end result is a combined light pattern that meets all of the regulation requirements for a locomotive headlight pattern.

Figure 3:
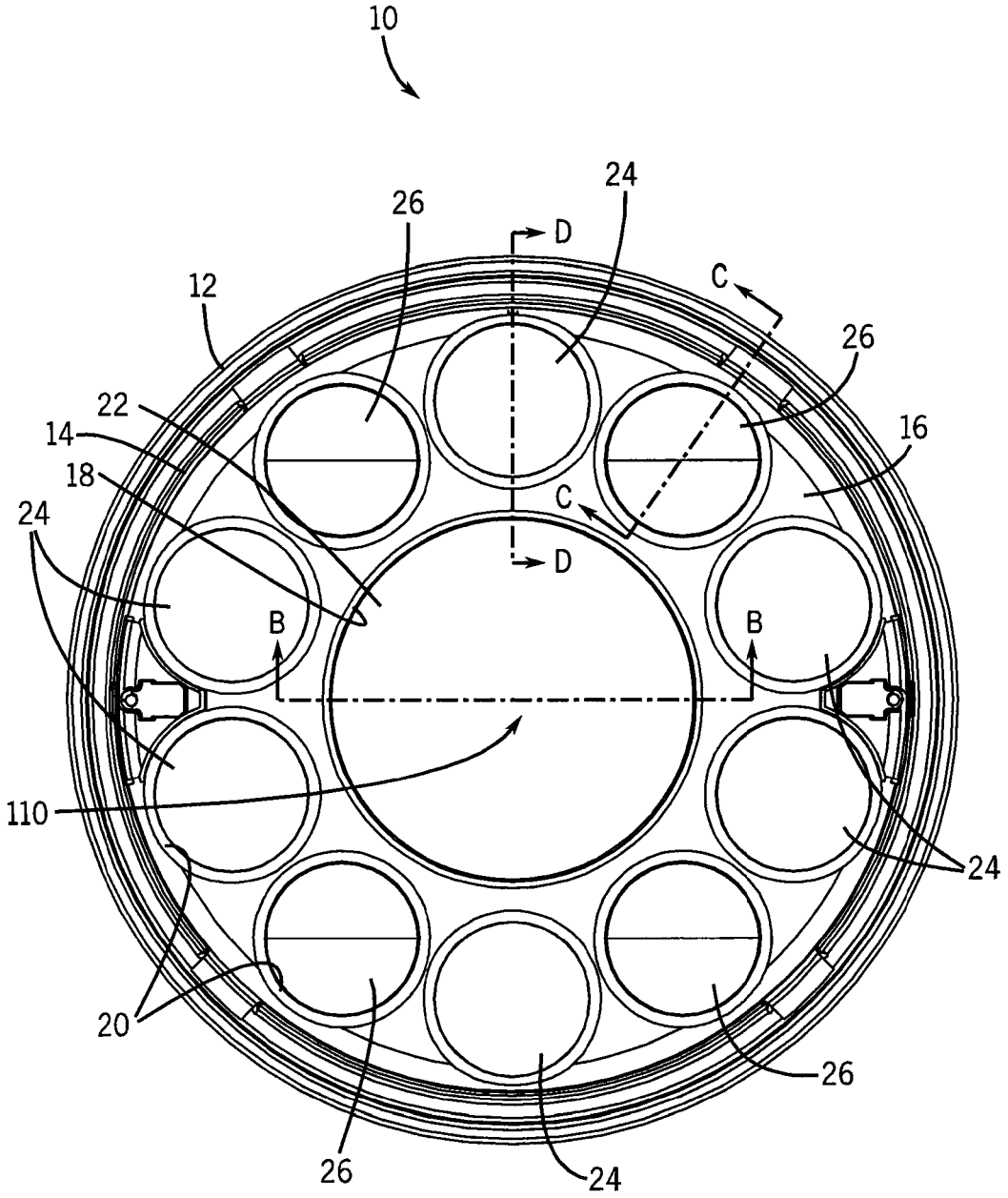
FIG. 3 is a front plan view of the assembly shown in FIG. 1.
Figure 4:
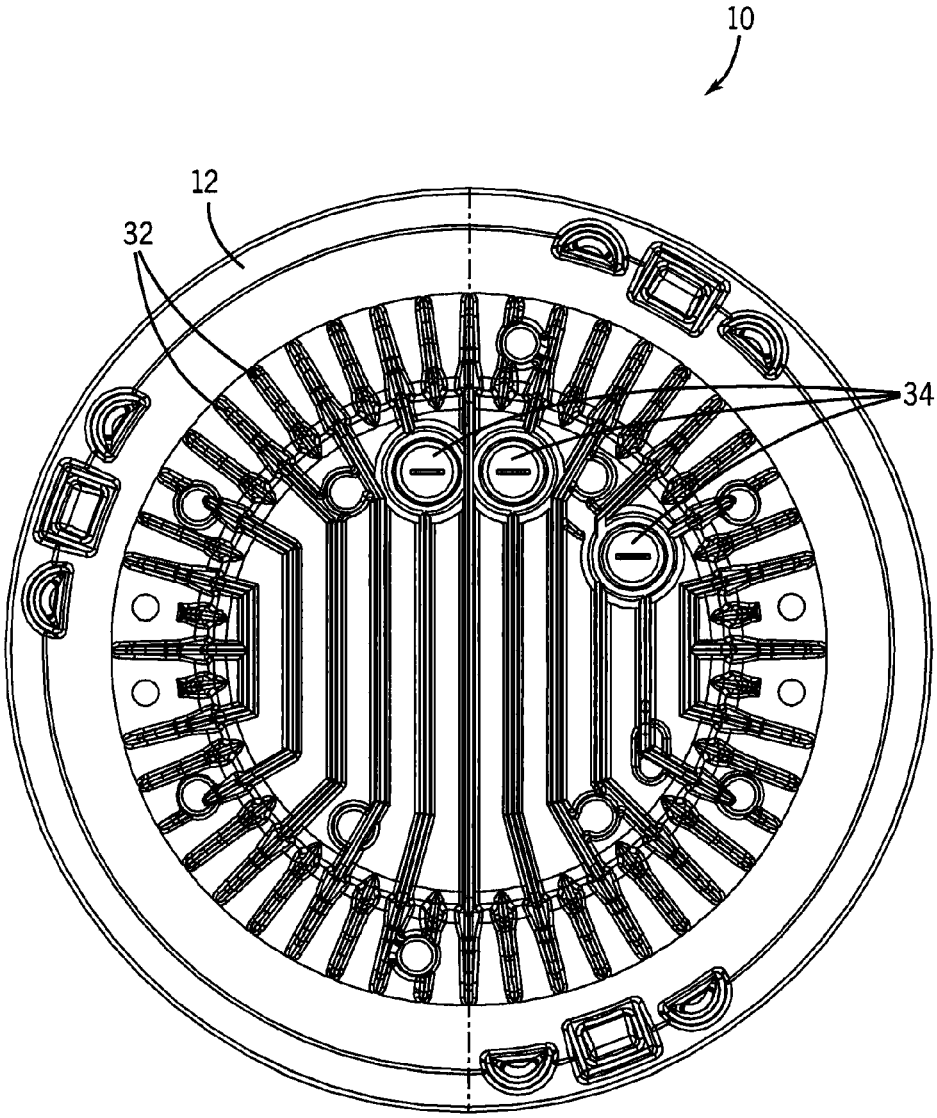
FIG. 4 is a rear plan view of the assembly shown in FIG. 1.

Referring again to FIGS. 1 and 5, fascia cover 16 is, in at least some embodiments, a molded plastic disc which forms a large central circular opening 18 and ten relatively small circumferential circular openings (three collectively labeled 20). The openings 18 and 20 are formed to be aligned with the optics 22, 24 and 26 as shown in FIG. 3 so that rear surface portions of the cover 16 contact front facing surfaces of the rims 65, 77 and 85 of the optic members 22, 24 and 26. Thus, the cover openings position the optics 22, 24 and 26 optimally within the housing 12 upon installation.

Lens 30 is generally a bowed disc shaped glass or plastic member that forms a rim (not labeled) that mates mechanically with the rim 14 of housing 12 upon installation. Lens 30 is clear in the locomotive application.

To assemble the headlight, the PCBs 40 and 42 including the LEDs and other circuitry are mechanically mounted to (or adhered to) the cavity mounting surfaces 54 and 52, respectively. Optics 22, 24 and 26 are positioned within the openings 18 and 20 formed by cover 16 in the pattern illustrated in FIGS. 1 and 3 and then baffle 28 is positioned with the openings 59, 71 formed thereby aligned with the optics and with a front surface thereof pressed up against the rear surfaces of the optics 22, 24 and 26. Mechanical fasteners (e.g., screws, snaps, etc.) are used to secure cover 16 to baffle 28 with the optics sandwiched there between. Next, the cover/optics/baffle subassembly is positioned within cavity 50 with the portion of the rear surface of baffle 28 adjacent the edge supported on the shelf surface 33 (see FIG. 6) and with the optics and reflectors aligned with the LEDs 56 and 58. Next, a bead of adhesive is applied to the rim 14 of housing 12 and lens 30 is pressed against the rim to adhere the lens 30 to the housing and to sandwich the cover/optics/baffle subassembly between the lens 30 and the rim of the housing 12.

One important aspect of at least some embodiments of the present invention is that the housing 12 is designed to accommodate optics and associated reflectors that have different depth dimensions while still having an external shape and dimensions that have a form factor that can be received in a space provided for a headlight on a standard existing locomotive. By providing a total headlight package that can fit within a standard space, the headlight 10 can be used as a replacement for existing incandescent type locomotive headlights. To construct a headlight that meets the form factor requirements and still generates a light pattern that meets or even exceeds light pattern requirements, in at least some embodiments as described above, the housing cavity 12 has PCB mounting surfaces that are two different depths (see surfaces 54 and 52). The deeper surface 58 has a depth designed to accommodate the larger central reflector cone 60 and associated larger optic 22 and the more shallow surface 52 has a depth designed to accommodate the smaller reflector cones 70 (see again FIG. 7) and associated smaller optics 26 and optics 24. Without the deeper surface 40, only optics and reflectors of smaller depths would be possible and the overall light pattern requirements could not be met.

Another aspect of at least some embodiments of the invention is that the resulting light pattern is symmetrical about the central headlight axis (see 69 in FIG. 7). Because headlight 10 generates a pattern that is axis symmetrical, the light pattern is identical and should be regulation requirements irrespective of the orientation of the light 10 about the central axis 69. Thus, for instance, referring again to FIG. 3 where the light axis is identified by point 110 which is into the figure, the light pattern (see FIG. 8) should remain substantially unchanged if light 10 were rotated about axis 110 by 10 degrees, 50 degrees, 120 degrees, or any other angle of rotation.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

Thus, the invention is to cover all modifications, equivalents, and alternatives falling within the spirit and scope of the invention as defined by the following appended claims.

To apprise the public of the scope of this invention, the following claims are made:

What is claimed is:

1. A headlamp assembly comprising:

a housing forming an internal chamber and forming an opening to one side that opens into the chamber;

at least a first light source having a first illumination axis, the first light source mounted in a central portion of the internal chamber substantially at a first depth and to direct light out the opening;

at least a second light source having a second illumination axis, the second light source mounted in a circumferential portion of the chamber substantially at a second depth and positioned to direct light out the opening wherein the first depth is greater than the second depth;

a first aspherical lens formed about a first optic axis, the first aspherical lens mounted within the opening with the first optic axis aligned with the first illumination axis so that the first aspheric lens substantially collimates at least a portion of the light from the first light source; and a second aspherical lens formed about a second optic axis, the second aspherical lens mounted within the opening with the second optic axis aligned with the second illumination axis so that the second aspheric lens substantially collimates at least a portion of the light from the second light source.

2. The assembly of claim 1 wherein the chamber has a central portion and a circumferential portion that surrounds the central portion, the central and circumferential portions have the first and second depths, respectively.

3. The assembly of claim 2 wherein the chamber is formed in part by a base wall member, a cylindrical side wall member and a circumferential wall member wherein the base wall member and circumferential wall member each form a substantially flat surface, the base wall member is substantially circular, the circumferential wall member is substantially ring shaped and the side wall member connects an outer edge of the base wall member to an inner edge of the circumferential wall member.

4. The assembly of claim 3 wherein the first and second light sources include first and second LEDs mounted to first and second PCBs, respectively, the first PCB mounted to a central portion of the base wall member and the second PCB mounted to the circumferential wall member.

5. The assembly of claim 4 further including at least a third LED mounted to the second PCB, the third LED having a third illumination axis and positioned to direct light out the opening.

6. The assembly of claim 4 further including a plurality of additional LEDs mounted to the second PCB and a separate lens mounted within the opening and aligned with each of the additional LEDs.

7. The assembly of claim 6 wherein the second PCB is ring shaped.

8. The assembly of claim 1 wherein the housing is formed of aluminum.

9. The assembly of claim 1 further including a plurality of additional light sources mounted in the circumferential portion of the chamber substantially at the second depth and positioned to direct light out the opening and a plurality of additional aspherical lens mounted within the opening, a separate one of the additional aspherical lenses aligned with each of the additional light sources so that the additional aspherical lenses substantially collimates at least portions of the light from the additional light sources.

10. The assembly of claim 9 wherein the second light source and the plurality of additional light sources include a first plurality of light sources, the assembly further including a second plurality of additional light sources mounted in the circumferential portion of the chamber substantially at the second depth and positioned to direct light out the opening and a plurality of concentrator lenses mounted within the opening, a separate one of the concentrator lenses aligned with each of the second plurality of additional light sources.

11. The assembly of claim 10 wherein the first plurality of light sources includes four light sources spaced about the circumferential portion and the second plurality of additional light sources includes six additional light sources.

12. The assembly of claim 11 wherein the second and additional aspherical lenses include a circumferential set of aspherical lenses and wherein the concentrator lenses separate the lenses in the circumferential set.

13. The assembly of claim 10 wherein each of the lenses is formed about an optic axis and wherein all of the optic axis of the lenses are substantially parallel.

14. The assembly of claim 1 wherein the assembly is formed about a light axis and wherein the light pattern created by the light sources is substantially symmetrical about the light axis such that the light pattern is substantially constant irrespective of how the assembly is rotated about the light axis.

15. A headlamp assembly comprising:

a housing forming an internal chamber and forming an opening to one side that opens into the chamber;

a plurality of light sources, each light source having an illumination axis and each mounted in the internal chamber to direct light out the opening, the plurality of light sources including a first light source;

a first aspherical lens formed about a first optic axis and having a first depth along the first optic axis, the first aspherical lens mounted within the opening with the first optic axis coaxially aligned with the illumination axis of the first light source so that the first aspheric lens substantially collimates at least a portion of the light from the first light source;

a plurality of second aspherical lenses, each of the second aspherical lenses formed about a separate optic axis and having a second depth along the separate optic axis that is less than the first depth, each second aspherical lens mounted within the opening with the separate optic axis coaxially aligned with one of the illumination axis of one of the light sources except the first light source so that each second aspherical lens substantially collimates at least a portion of the light from the aligned light source;

wherein, the all of the optic axis are substantially parallel and wherein the second aspherical lenses surround the first aspherical lens.

16. The assembly of claim 15 wherein the first aspheric lens forms a first diameter that is substantially perpendicular to the first optic axis and each of the second aspherical lenses forms a diameter that is substantially perpendicular to the optic axis of the second aspherical lens and wherein the second diameter is less than the first diameter.

17. The assembly of claim 16 wherein the second diameter is less than 90% of the first diameter.

18. The assembly of claim 17 wherein the second diameter is less than half the first diameter.

19. The assembly of claim 15 wherein the second depth dimension is less than 90% of the first depth dimension.

20. The assembly of claim 19 wherein the second depth dimension is less than half the first depth dimension.

21. A headlamp assembly comprising:

a housing forming an internal chamber and forming an opening to one side that opens into the chamber;

a plurality of light sources, each light source having an illumination axis and each mounted in the internal chamber to direct light out the opening, the plurality of light sources including a first light source;

a first aspherical lens formed about a first optic axis and having a first depth along the first optic axis, the first aspherical lens mounted within the opening with the first optic axis coaxially aligned with the illumination axis of the first light source so that the first aspheric lens substantially collimates at least a portion of the light from the first light source;

a plurality of second aspherical lenses, each of the second aspherical lenses formed about a separate optic axis and having a second depth along the separate optic axis that is less than the first depth, each second aspherical lens mounted within the opening with the separate optic axis coaxially aligned with one of the illumination axis of one of the light sources except the first light source so that each second aspherical lens substantially collimates at least a portion of the light from the aligned light source;

wherein, the second aspherical lenses surround the first aspherical lens.

* * * * *